US007857049B2

(12) United States Patent
Sherwood

(10) Patent No.: US 7,857,049 B2
(45) Date of Patent: Dec. 28, 2010

(54) SYSTEM AND METHOD FOR OPERATIONAL MANAGEMENT OF A GUARDED PROBE FOR FORMATION FLUID SAMPLING

(75) Inventor: John D. Sherwood, Cambridge (GB)

(73) Assignee: Schlumberger Technology Corporation, Ridgefield, CT (US)

( * ) Notice: Subject to any disclaimer, the term of this patent is extended or adjusted under 35 U.S.C. 154(b) by 104 days.

(21) Appl. No.: 11/534,515

(22) Filed: Sep. 22, 2006

(65) Prior Publication Data

US 2008/0073078 A1 Mar. 27, 2008

(51) Int. Cl.
*E21B 47/00* (2006.01)
*E21B 49/08* (2006.01)
*E21B 49/10* (2006.01)

(52) U.S. Cl. ..... 166/264; 166/100

(58) Field of Classification Search ..... 166/264, 166/100, 66; 175/152.24, 152.28; 703/10
See application file for complete search history.

(56) References Cited

U.S. PATENT DOCUMENTS

| | | | | |
|---|---|---|---|---|
| 3,611,799 | A | 10/1971 | Davis | |
| 4,416,152 | A | 11/1983 | Wilson | |
| 4,860,581 | A | 8/1989 | Zimmerman et al. | |
| 4,936,139 | A | 6/1990 | Zimmerman et al. | |
| 6,178,815 | B1 * | 1/2001 | Felling et al. | 73/152.19 |
| 6,223,822 | B1 | 5/2001 | Jones | |
| 6,230,557 | B1 * | 5/2001 | Ciglenec et al. | 73/152.01 |
| 6,274,865 | B1 | 8/2001 | Schroer et al. | |
| 6,301,959 | B1 * | 10/2001 | Hrametz et al. | 73/152.23 |
| 6,350,986 | B1 | 2/2002 | Mullins et al. | |
| 6,388,251 | B1 * | 5/2002 | Papanyan | 250/269.1 |
| 6,585,045 | B2 * | 7/2003 | Lee et al. | 166/252.5 |
| 6,609,568 | B2 | 8/2003 | Krueger et al. | |
| 6,719,049 | B2 * | 4/2004 | Sherwood et al. | 166/264 |
| 6,799,117 | B1 | 9/2004 | Proett et al. | |
| 7,251,565 | B2 | 7/2007 | Storm, Jr. et al. | |
| 7,347,262 | B2 * | 3/2008 | Tarvin et al. | 166/264 |
| 2003/0217845 | A1 | 11/2003 | Sherwood et al. | |
| 2004/0000433 | A1 * | 1/2004 | Hill et al. | 175/59 |

(Continued)

FOREIGN PATENT DOCUMENTS

GB 2418938 A 4/2006

(Continued)

OTHER PUBLICATIONS

Hammond One- and two-phase flow during fluid sampling by a wireline tool Transport in porous media, vol. 6, 1991, pp. 299-330.

*Primary Examiner*—Jennifer H Gay
*Assistant Examiner*—Cathleen R Hutchins
(74) *Attorney, Agent, or Firm*—Vincent Loccisano; James McAleenan; Brigid Laffey

(57) ABSTRACT

Embodiments of the present invention relate to systems and methods for real-time management of a guarded probe device down a wellbore that is being used for formation fluid sampling. More specifically, but not by way of limitation, embodiments of the present invention provide for operational management of the guarded probe device to provide for splitting a flowline coupled with the guarded probe into two separate flow lines after the sampling process has begun, wherein one of the two separate flow-lines is coupled with a sampling probe in the guarded probe device and the other flowline is coupled with a guard probe in the guarded probe device.

27 Claims, 6 Drawing Sheets

U.S. PATENT DOCUMENTS

| | | | | |
|---|---|---|---|---|
| 2004/0104341 | A1 | 6/2004 | Betancourt et al. | |
| 2004/0260497 | A1 | 12/2004 | DiFoggio et al. | |
| 2005/0165554 | A1 | 7/2005 | Betancourt et al. | |
| 2005/0246151 | A1 | 11/2005 | DiFoggio | |
| 2005/0257611 | A1 | 11/2005 | Fogal et al. | |
| 2006/0000603 | A1 | 1/2006 | Zazovsky et al. | |
| 2006/0042793 | A1* | 3/2006 | Del Campo et al. | 166/264 |
| 2006/0117842 | A1* | 6/2006 | Ramakrishnan | 73/152.55 |
| 2006/0129365 | A1* | 6/2006 | Hammond | 703/10 |
| 2006/0155474 | A1* | 7/2006 | Venkataramanan et al. | 702/13 |
| 2007/0119244 | A1* | 5/2007 | Goodwin et al. | 73/152.28 |
| 2008/0125973 | A1 | 5/2008 | Sherwood et al. | |

FOREIGN PATENT DOCUMENTS

| | | | |
|---|---|---|---|
| GB | 2442110 | A | 3/2008 |
| RU | 2183269 | C2 | 6/2002 |
| WO | 96/30628 | A1 | 10/1996 |
| WO | 2004099552 | A3 | 11/2005 |
| WO | 2005065277 | A3 | 7/2006 |

* cited by examiner

SYSTEM AND METHOD FOR OPERATIONAL MANAGEMENT OF A GUARDED PROBE FOR FORMATION FLUID SAMPLING

CROSS-REFERENCE TO RELATED APPLICATIONS

This application is related to U.S. application Ser. No. 11/534,472, filed on a date even herewith by J. D. Sherwood and O. Mullins and entitled "System and Method for Real-Time Management of Formation Fluid Sampling with a Guarded Probe", the disclosure of which is incorporated herein by reference for all purposes.

BACKGROUND OF THE INVENTION

Wellbores may be drilled into earth formations to provide for location and production of various types of hydrocarbons. To form a wellbore, a downhole drilling tool with an attached bit at one end is advanced into the earth formation. As the drilling tool is advanced, a drilling mud or drilling fluid is pumped into the drilling tool and out the through the drill bit to provide for cooling of the drilling tool and carrying away of cuttings made by the interaction of the drill bit with the earth formation. In the drilling process, after interacting with the drilling tool, the drilling mud/fluid flows up through the wellbore to the surface. At the surface, the drilling mud/fluid may be collected and recirculated through the drill tool. In the process of drilling the wellbore, the drilling mud forms a mudcake/filter cake on the wall of the wellbore that may act to separate the wellbore from the surrounding earth formation.

During the drilling of the wellbore and/or after drilling of the wellbore, it is often desirable to evaluate the earth formations penetrated by the wellbore. In some processes, the drilling tool may be provided with devices to test and/or sample the surrounding formation in processes often referred to as measurement while drilling. In other processes, the drilling tool may be removed from the wellbore and a wireline with one or more attached tools may be deployed into the wellbore to test and/or sample the earth formations adjacent to the wellbore. In yet other processes, the drilling tool itself may be used to perform the testing or sampling of the surrounding earth formations. The testing and sampling of the earth formations may provide for formation evaluation, such as locating hydrocarbons, determining the presence of non-hydrocarbon fluids, determining a composition of formation fluids present in an adjacent earth formation and/or the like.

In a formation evaluation process, it is often necessary to draw formation fluids from the formation into a downhole tool for testing and/or sampling. Various devices, such as probes or the like, may be extended from the downhole tool to establish fluid communication with the formation surrounding the wellbore and provide for drawing formation fluid from the formation into the downhole tool. Such a probe for formation sampling may be a circular element that may be extended from the downhole tool and contacted with and/or pushed into/through the sidewall of the wellbore. A rubber packer may be provided at the end of the probe to provide for sealing the probe with the sidewall of the wellbore. Another device that may be used to form a seal with the wellbore sidewall is commonly referred to as a dual packer. In a dual packer, two elastomeric rings expand radially about the tool to isolate a portion of the wellbore therebetween. The rings form a seal with the wellbore wall and permit fluid to be drawn into the isolated portion of the wellbore and into an inlet in the downhole tool.

The mudcake/filter cake lining the wellbore may be useful in assisting the probe, dual packers or the like in making the seal with the wellbore sidewall. Once the seal is made, fluid from the formation may be drawn into the downhole tool through an inlet by lowering the pressure in the downhole tool. Examples of probes and/or packers used in downhole tools are described in U.S. Pat. Nos. 6,301,959; 4,860,581; 4,936,139; 6,585,045; 6,609,568 and 6,719,049 and U.S. Patent Application No. 2004/0000433.

In the petroleum exploration and recovery industries, samples of formation fluids may be collected and analyzed for various purposes, such as to determine the existence, composition and producibility of subsurface hydrocarbon fluid reservoirs and/or the like. This aspect of the exploration and recovery process may be very important in developing drilling strategies and impacts significant financial expenditures and savings.

To conduct a valid fluid analysis, the fluid obtained from the subsurface formation should possess sufficient purity, or be virgin fluid, to adequately represent the fluid contained in the formation. As used herein, and in the other sections of this patent, the terms "virgin fluid", "acceptable virgin fluid" and variations thereof mean subsurface fluid that is pure, pristine, connate, uncontaminated or otherwise considered in the fluid sampling and analysis field to be sufficiently or acceptably representative of a given formation for valid hydrocarbon sampling and/or evaluation.

Challenges/issues may arise in the process of obtaining virgin fluid from subsurface formations with regard to accessing the formation fluids to be sampled/evaluated. With regard to the petroleum-related industries, the earth around the borehole from which fluid samples are sought typically contains contaminates, such as filtrate from the mud/fluids used in the drilling process. This material may contaminate the formation fluid as the mud/fluid passes through the borehole, resulting in a combination fluid that is not the same as the virgin formation fluid and is, therefore, not useful for the fluid sampling and/or evaluation processes. Such a combination of drilling and formation fluids may be referred to herein as "contaminated fluid" or the like. Since in order to sample formation fluid from areas surrounding the wellbore, the samples must be sampled through the wellbore and the mudcake, cement and/or other layers comprising/surrounding the wellbore sidewall, it is difficult to avoid contamination of the fluid sample as it flows from the formation and into a downhole tool during sampling.

Various methods and devices have been proposed for obtaining pure formation fluids for sampling and evaluation. For example, U.S. Pat. No. 6,230,557 to Ciglenec et al., U.S. Pat. No. 6,223,822 to Jones, U.S. Pat. No. 4,416,152 to Wilson, U.S. Pat. No. 3,611,799 to Davis and International Pat. App. Pub. No. WO 96/30628 describe, among other things, sampling probes and techniques for improving formation fluid sampling. Additionally, guarded probes, such as disclosed in U.S. Pat. No. 6,301,959 to Hrametz et al., have been disclosed for formation fluid sampling. In a guarded probe, a sampling probe is provided that comprises two hydraulic lines to recover formation fluids from two zones in the wellbore. In operation, wellbore fluids—such as drilling mud, drilling fluids, filtrates of the foregoing or the like—may be preferentially drawn into a guard zone, connected to one of the hydraulic lines, while formation fluids may be drawn into a probe zone, connected to the other hydraulic line. Thus, the probe zone may collect purer formation fluids for analysis. However, while guarded probes may provide for better sampling, they are in general expensive and more complicated to effectively operate then a nonguarded probe.

BRIEF SUMMARY OF THE INVENTION

Embodiments of the present invention relate to systems and methods for real-time management of a guarded probe device down a wellbore, the guarded probe being used for formation fluid sampling. More specifically, but not by way of limitation, embodiments of the present invention may provide for operational management of the guarded probe device when the guarded probe device is being used downhole to collect formation fluid samples, such that functionality of a guard and a sampling probe of the guarded probe device may be separated during operation of the guarded probe device.

In one embodiment of the present invention, a wellbore tool coupled with a fluid sampling device is lowered into a wellbore, the fluid sampling device comprising a sampling probe and a guard probe, wherein the sampling probe and the guard probe are adjacent to one another and wherein the sampling probe may be configured for withdrawing a fluid sample from the formation and the guard probe may be configured to draw wellbore fluids away from the sampling probe to provide that the sampling probe receives formation fluids that have decreased or no wellbore fluid content.

In an embodiment of the present invention, the sample probe and guard probe may be connected to a single flow line when the fluid sampling device begins obtaining downhole fluids. A property of the fluids being received by the fluid sampling device may be measured by a sensor and the measurement may be passed to a processor. In certain aspects, the property of the fluids being received by the fluid sampling device that are measured may be wellbore fluid contamination levels, temperature, levels of certain chemicals in the received fluids, pressure, amounts of tracers previously disposed in the wellbore and/or the like. Sensors that may be used may include optical fluid analyzers, temperature sensors, pressure sensors, chemical detectors and/or the like.

In an embodiment of the present invention, the processor may use changes in the measured property to determine when to split the single flow line into a guard flow line and a sampling flow line. In certain aspects, the determination as to when to split the single flow line into the guard flow line and the sampling flow line may be made according to a mathematical model, mathematical analysis, experimental determinations, prior sampling results and/or the like. Splitting of the flow line into the sampling flow line and the guarded flow line may comprise opening/closing valves in a flow line system, using multiple pumps with separate pumps connected to each of the sampling and guarded probes and/or the like.

In an embodiment of the present invention, a sample of the formation fluid collected by the sampling probe of the fluid sampling device may be collected after the single flow line is split into the sampling flow line and the guarded flow line. In certain aspects, after the single flow line is split into the sampling flow line and the guarded flow line. One or more sensors may be used to measure properties of the fluids flowing in one or more of the separated flow lines. In such aspects of the present invention, the measurements of the properties of the fluids in one or more of the separated flow lines may be processed to provide for management of the operation of the fluid sampling device. Such management may include determining when to switch the separated flow line to a single flow line, collect samples from the sample flow line and/or the guarded flow line and/or the like. Furthermore, as described in the patent application filed contemporaneously with the present application, titled "System and Method for Reservoir Characterization and Real-Time Management of Formation Fluid Sampling Using a Guarded Probe" referenced herein by Ser. No. 11/534,472.

BRIEF DESCRIPTION OF THE DRAWINGS

In the figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

The present invention will become more fully understood from the detailed description and the accompanying drawings, wherein.

DETAILED DESCRIPTION OF THE INVENTION

The ensuing description provides preferred exemplary embodiment(s) only, and is not intended to limit the scope, applicability or configuration of the invention. Rather, the ensuing description of the preferred exemplary embodiment (s) will provide those skilled in the art with an enabling description for implementing a preferred exemplary embodiment of the invention. It being understood that various changes may be made in the function and arrangement of elements without departing from the spirit and scope of the invention as set forth in the appended claims.

Specific details are given in the following description to provide a thorough understanding of the embodiments. However, it will be understood by one of ordinary skill in the art that the embodiments maybe practiced without these specific details. For example, circuits may be shown in block diagrams in order not to obscure the embodiments in unnecessary detail. In other instances, well-known circuits, processes, algorithms, structures, and techniques may be shown without unnecessary detail in order to avoid obscuring the embodiments.

Also, it is noted that the embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed, but could have additional steps not included in the figure. A process may correspond to a method, a function, a procedure, a subroutine, a subprogram, etc. When a process corresponds to a function, its termination corresponds to a return of the function to the calling function or the main function.

Figure 1:
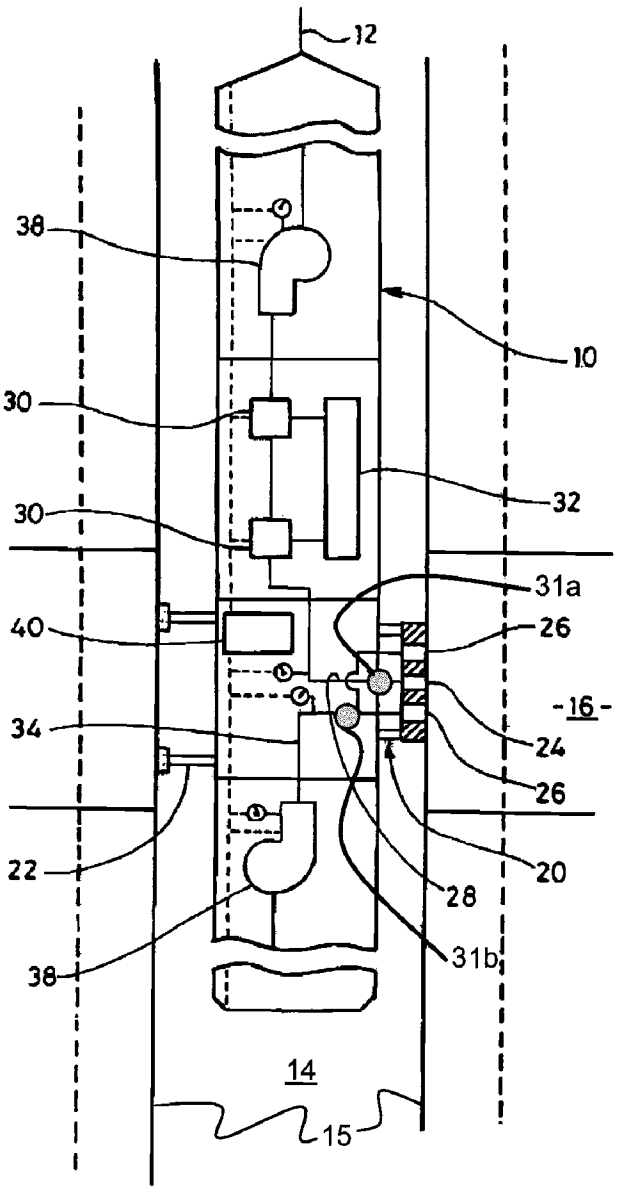
FIG. 1 is a schematic-type illustration of a fluid sampling apparatus, in accordance with an embodiment of the present invention, disposed in a borehole penetrating an earth formation, the fluid sampling apparatus comprising a borehole tool incorporating a sampling probe device through which fluid samples may be withdrawn from the formation.

With reference now to the drawings, the apparatus shown in FIG. 1 comprises a modular wellbore tool 10 suspended on a wireline 12—the wireline 12 may be a slickline, a drill-string or the like—in a wellbore 14 penetrating an earth formation 16. In certain situations, the earth formation 16 may contain exploitable, i.e., recoverable, hydrocarbons. The wellbore 14 comprises a sidewall 15. Surrounding the wellbore 14, to a radial distance of the order of tens of centimeters, is an invaded zone (not shown) of the earth formation 16 into which contaminants from fluids flowing in the wellbore 14, such as filtrate from drilling mud used in the drilling of the wellbore 16 or the like, have penetrated from the wellbore 14 into the sidewall 15 and the earth formation 16.

The wellbore tool 10 comprises a sampling probe device 20 which is described in more detail hereinafter and which projects from the tool. In one embodiment of the present invention, the sampling probe device 20 may be urged into contact with a part of the sidewall 15 that is adjacent to the earth formation 16. An anchoring device 22 may provide the urging of the sampling probe device 20. In such an operation, the anchoring device 22 may be mounted on the side of the wellbore tool 10 and positioned substantially opposite to the sampling probe device 20, which may be pressed against the sidewall 15 by the configuration of the wellbore tool 10 and the anchoring device 22.

The sampling probe device 20 may comprise one or more of each of a fluid sampling probe 24 and a guard probe 26. In certain embodiments, the one or more of the fluid sample probe 24 and the guard probe 26 may be distinct probes positioned adjacent to one another. In certain aspects, a plurality of guard probes 26 may be positioned adjacent to and around/surrounding a single one of the fluid sampling probe 24. As depicted in FIG. 1, the sampling probe device 20 may be configured to comprise the fluid sampling probe 24 as an inner probe that is surrounded by the guard probe 26. In certain aspects, respective flow areas of the fluid sampling probe 24 and the guard probe 26 may be varied to provide for different sampling characteristics of the sampling probe device 20.

In certain embodiments of the present invention, the fluid sampling probe 24 may be selectively connectable, via a sampling flowline 28 that may contain a pair of changeover (or diverter) valves 30, either to a sample chamber 32 or to a dump outlet (not shown). In such embodiments, the guard probe 26 may be coupled, via a guard flowline 34, with a dump outlet (not shown). In some embodiments of the present invention, the guard probe 26 may also, like the fluid sampling probe 24, be selectively connected via an outlet conduit and valves or the like to either a dump outlet or a sample chamber. As such, in operation of such embodiments, the fluid sampling probe 24, the guard probe 26 and or a combination of both the fluid sampling probe 24 and the guard probe 26 may be used to collect fluid samples from the earth formation 16.

In an embodiment of the present invention, both the fluid sampling probe 24 and the guard probe 26 may be arranged to draw fluid samples from the earth formation 16. In certain aspects of the present invention, one or more pumps 38 and a control system 40, which may control the valves 30 and the pumps 38, may be used to control the drawing of fluid samples from the earth formation 16 by the fluid sampling probe 24 and the guard probe 26. Control of the fluid sampling may be provided by using the pumps 38 to change the pressure at the fluid sampling probe 24 and/or the guard probe 26.

In an embodiment of the present invention, fluid sensors 31*a* and 31*b* may be used to measure one or more properties of fluid samples obtained by the fluid sampling probe 24 and/or the guard probe. In certain embodiments, the fluid sensors 31*a* and 31*b* may be positioned in the sampling outlet conduit 28 and the guard outlet conduit 34, respectively. In other embodiments, a single sensor may take the place of the fluid sensors 31*a* and 31*b* and the single sensor may be positioned in a flow line associated with either the sampling or the guard probe. In certain aspects, the sensors 31*a* and 31*b* may determine the composition of the fluid samples obtained by the fluid sampling probe 24 and/or the guard probe 26. This composition determination may comprise a determination of an amount of contamination in the fluid samples obtained form the fluid sampling probe 24 and/or the guard probe 26. In other aspects, the sensors 31*a* and 31*b* may determine other properties of the fluid samples such as temperature, pressure or the like.

In an embodiment of the present invention, the control unit 40 may control the pumps 38 to apply equivalent pumping to both the fluid sampling probe 24 and the guard probe 26. In such a way the sampling flowline 28 and the guard flowline 34 have equivalent characteristics, operating as essentially a single flowline. Subsequently, the outputs from the sensors 31*a* and 31*b* may be processed and the control unit 40 may change the settings of the pumps 38 to provide for effectively splitting the essentially single flowline. In an embodiment of the present invention, the pumps 38 may be replaced by a single pump 38 connected by flow-lines and valves to fluid sampling probe 24 and the guard probe 26. In such a configuration, the control unit 40 may be configured to control the valves and flow-lines to provide that fluid sampling probe 24 and the guard probe 26 are attached to a single flowline during initial sampling of fluids from the earth formation 16. After processing measurements of properties of fluids flowing through the single flowline that is coupled with the fluid sampling probe 24 and the guard probe 26, the control unit 40 may provide for splitting the single flowline into separate flow-lines one of which is coupled with the fluid sampling probe 24 and one of which is coupled with the guard probe 26.

In the wellbore tool 10 of FIG. 1, fluid is drawn into the sample chamber 32 without passing through the pump 38. In other embodiments, the fluid drawn into the wellbore tool 10 may pass through the relevant pump 38 en route to the sample chamber 32. In other embodiments, a single pump may be used in place of the two pumps 38 depicted in FIG. 1. Additionally, the guard flow line 34 may be provided with valves and a sample chamber analogous to the valves 30 and sample chamber 32, so that the fluid obtained via the outer probe 26 can be selectively retained or dumped.

Figure 2A:
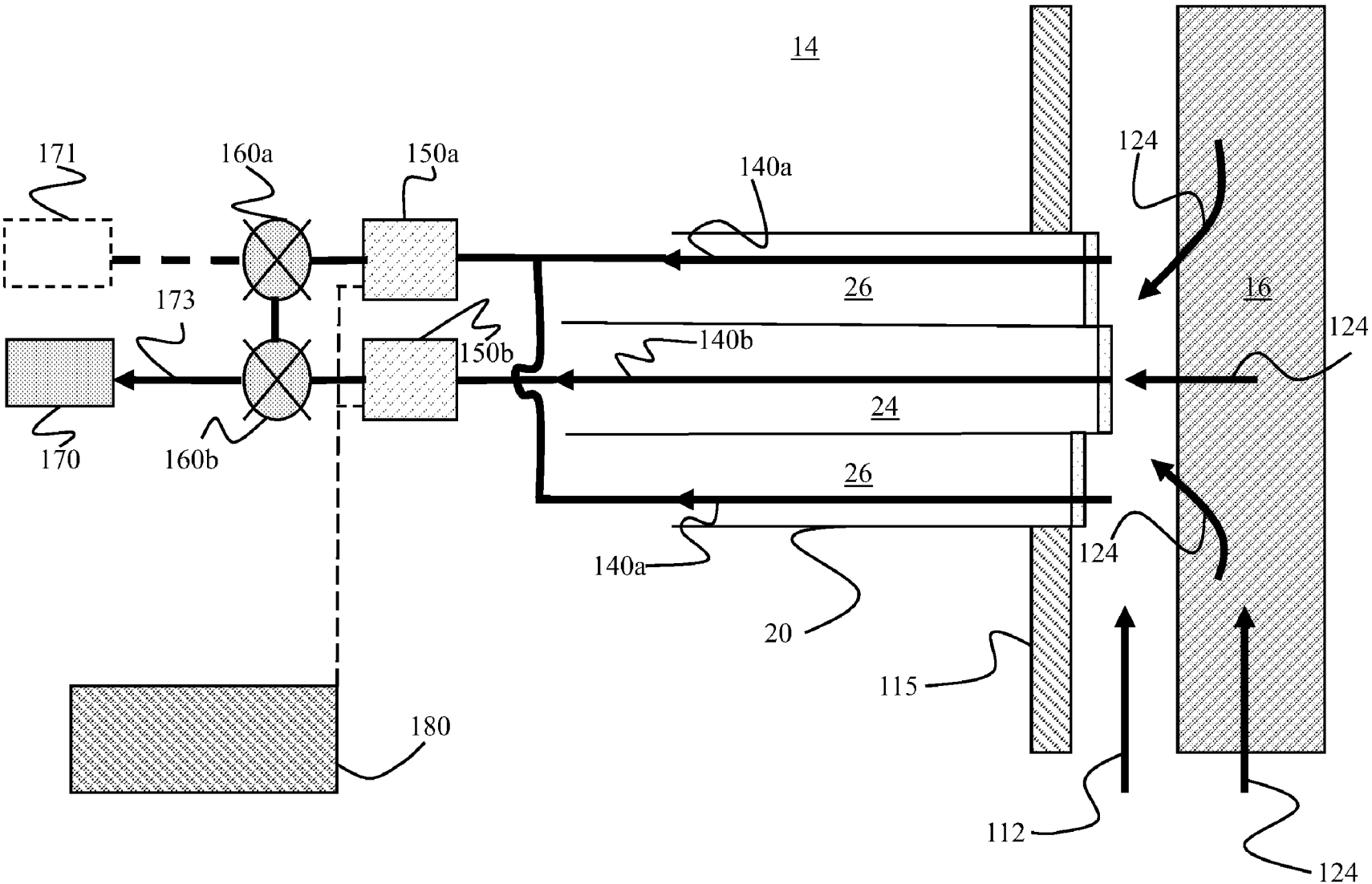
FIG. 2A is a schematic-type diagram illustrating a formation-fluid sampling system with a flowline management system configured to provide a single flow line to a sampling and a guard probe, in accordance with an embodiment of the present invention.

FIG. 2A is a schematic-type diagram illustrating a formation-fluid sampling system with a flowline management system configured to provide a single flow line to a sampling and a guard probe, in accordance with an embodiment of the present invention. In the depicted embodiment, the sampling probe device 20 may be contacted with a filter-cake layer 115 on the sidewall of the wellbore 14. The filter-cake layer 115 may comprise drilling mud, drilling mud components (mud filtrate), elements of drilling fluids, elements of wellbore fluids and the like. The sampling probe device 20 may be configured so that the fluid sampling probe 24 and/or the guard probe 26 penetrate the filter-cake layer 115. In certain aspects, the fluid sampling probe 24 and/or the guard probe 26 may project from the sampling probe device 20 to provide for penetration into the filter-cake. In some aspects, the fluid sampling probe 24 may project beyond the guard probe 26 to provide for further penetration into the filter-cake layer by the fluid sampling probe 24 relative to the guard probe 26. In certain aspects, the guard probes 26 may comprise independent probes disposed adjacent to the fluid sampling probe 24. In other aspects, as depicted, the fluid sampling probe 24 and the guard probe 26 may comprise a single guard probe encircling a fluid sampling probe.

In an embodiment of the present invention, a pump 170 or the like may be used to lower the pressure in the fluid sampling probe 24 and/or the guard probe 26. The pump 170 may be coupled with the fluid sampling probe 24 and the guard probe 26 via a single flow line 173 and a plurality of valves 160. In certain embodiments, a second pump 171 may be connected with one of the sampling probe 24 and/or the guard probe 26 via one of the valves 160*a* and 160*b*.

The pump 170 may draw the formation fluids 124 and the wellbore fluids 112 into the sampling probe device 20. As such, a guard flow 140*a* may flow through the guard probe 26 and a sample flow 140*b* may flow through the fluid sampling probe. As depicted, a guard sensor 150*a* may measure properties of the guard flow 140*a* and a sample sensor 150*b* may measure properties of the sample flow 140*b*. In certain aspects, the sensors 150*a* and 150*b* may comprise a single sensor that may measure properties of the guard flow 140*a* or the sample flow 140*b* or may be positioned so as to measure properties of a combined flow comprising the guard flow 140*a* and the sample flow 140*b*. In certain aspects, the properties that are measured may comprise temperature, pressure, contamination and or the like. The sensors 150*a* and 150*b* may comprise optical fluid analyzers, temperature sensors, pressure sensors and/or the like. With regard to contamination, the sensors 150*a* and 150*b* may generate a signal that is proportional to an amount of contamination measurable by the sensor.

A processor 180 or the like may be coupled with the sensors 150*a* and 150*b*. The processor 180, which may be a software program or the like, may process the measurements from the sensors 150*a* and 150*b* to determine properties of the fluids being received by the sampling probe device 20. In certain aspects of the present invention, the sensors 150*a* and 150*b* may generate an output signal S that is proportional to the contamination sensed in the flow in the sampling probe device 20, where the contamination comprises wellbore fluids—drilling mud, drilling mud filtrates, drilling fluids, wellbore treatment fluids—and or the like that contaminate the formation fluids. The processor 180 may process a contamination value from the output signal S, wherein the contamination value may comprise an amount of contamination in the volume of fluid flowing in the sampling probe device 20. To determine the contamination value, the processor may process a linear relationship between the output signal S and the contamination value, may be calibrated using known contamination values and/or the like.

In an embodiment of the present invention, the processor 180 may determine from the properties measured by the sensors 150*a* and 150*b* when to split the single flow line 173*a* into a guard flow line and a sample flow line. FIG. 2A shows one of many configurations that may be used to provide that the sampling probe 24 and the guard probe 26 may be connected to a single flow line. Different embodiments of the present invention may provide for many other configurations that provide for connecting the sampling probe 24 and the guard probe 26 to a single flow line and these configurations may include systems where the sampling probe 24 and the guard probe 26 are coupled with separate flow lines, but the separate flow lines are configured to have equivalent properties, such as pressure or the like.

Figure 2B:
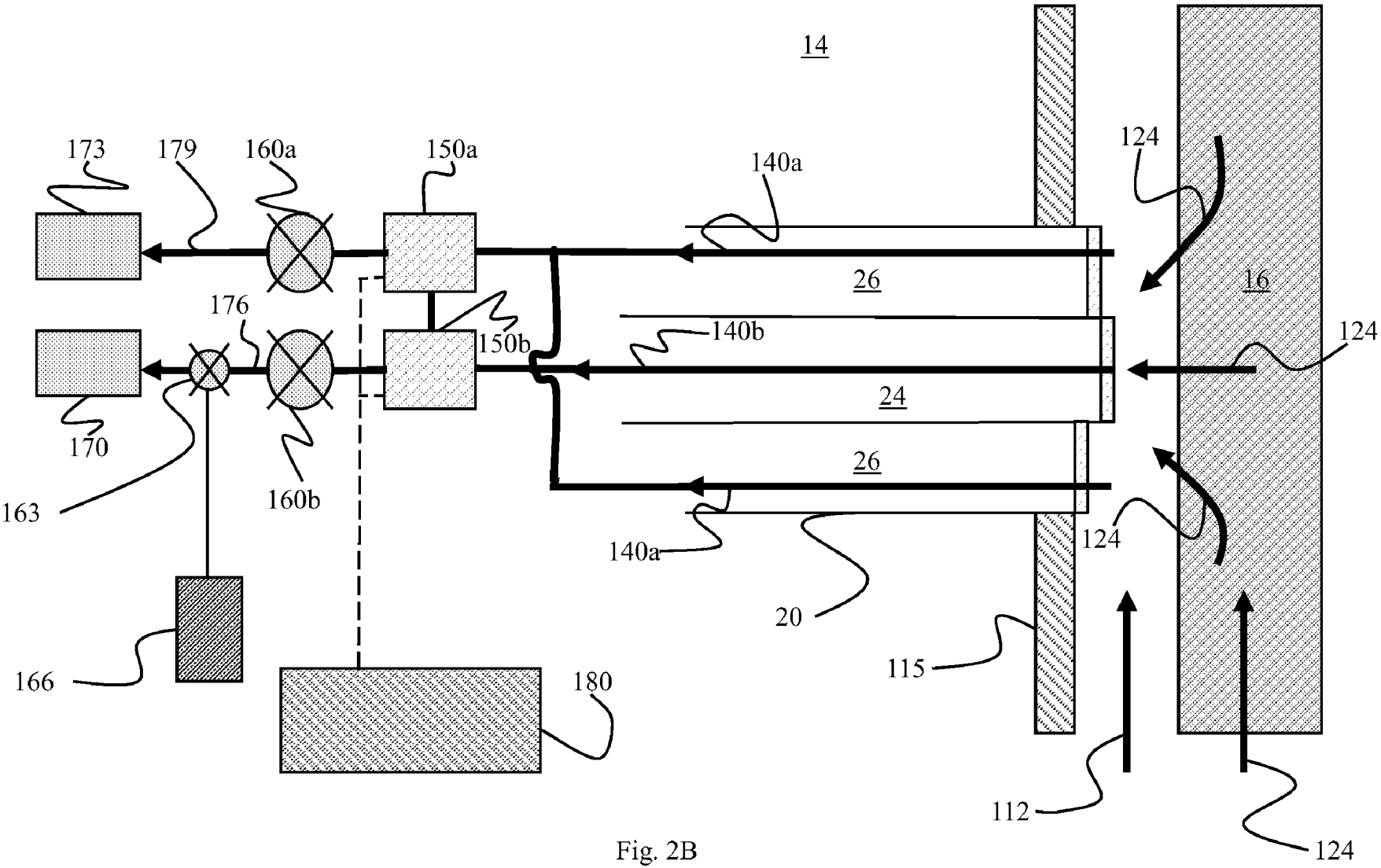
FIG. 2B is a schematic-type diagram illustrating a formation-fluid sampling system with a flowline management system configured to provide a split flow line to a sampling and a guard probe, in accordance with an embodiment of the present invention.

FIG. 2B is a schematic-type diagram illustrating a formation-fluid sampling system with a flowline management system configured to provide a split flow line to a sampling and a guard probe, in accordance with an embodiment of the present invention. In accordance with an embodiment of the present invention, the sensors 150*a* and 150*b* may produce the output signal S in response to sensing a property of the fluid flowing in the sampling probe device 20. The output signal S may correspond to an amount of contamination, a temperature, a pressure, a viscosity and/or the like. The fluid may comprise the formation fluids 124, the wellbore fluids 112 and/or the like. In certain aspects, a flow meter (not shown in FIG. 2B) may output a flow rate for the fluid to the processor 180. The flow rate may be a velocity, a volume flow and/or the like. In certain aspects, the sensors 150*a* and 150*b* may comprise a single sensor disposed within the sampling probe 24, the guard probe 26, a sampling flowline 176, a guard probe line 179 or the like.

In an embodiment of the present invention, the processor 180 may process the output signal or output signals from the sensors 150*a* and 150*b* to determine when to split the flow line to the fluid sampling probe 24 and the guard probe 26 into the sampling flowline 176 and the guard probe line 179. In FIG. 2*b*, an embodiment of the present invention is depicted in which the processor 180 has made the determination and split the flowline to the fluid sampling probe 24 and the guard probe 26 into the sampling flowline 176 and the guard probe line 179. In different embodiments of the present invention, arrangements of flow-lines, valves, pumps and/or the like may be used to provide for independent flow of fluids through the fluid sampling probe 24 and the guard probe 26. In certain aspects, once the sampling flowline 176 and the guard probe line 179 have been split, the pressures of the fluid sampling probe 24 and the guard probe 26 may be independently changed. In this way, the guard probe 26 may have a pressure equivalent or below that of the fluid sampling probe 24 after the split of the flow line to provide for drawing away of wellbore fluids 112 from the fluid sampling probe 24. Pressure in the fluid sampling probe 24 and the guard probe 26 may be lowered in some embodiments of the present invention by the pump 170 and/or the pump 173. In certain aspects, one or more pumps may be used with different valve configurations or the like to manipulate the pressure in the fluid sampling probe 24 and/or the guard probe 26.

In embodiments of the present invention, the determination as to when to switch the single flowline to the sampling flowline 176 and the guard probe line 179 may be made by various different methods. In one aspect, the processor 180 may be used to process the contamination of the fluid being received by the sampling probe device 20 from the output signal S and may provide for switching the flowline when this value is below a set constant, wherein the set constant may be determined mathematically, experimentally, from analysis of previous sampling and/or the like. In such aspects, the set constant may dependent on the amount of flow of fluid in the sampling probe device 20, which may be determined by a flow measuring device. In other aspects, the determination may be made based upon a delta function of the difference of output signals S from the sensor 150*a* and the sensor 150*b*; as described in more detail in the copending application U.S. application Ser. No. 11/534,472 titled "System and Method for Real-Time Management of Formation Fluid Sampling with a Guarded Probe". In yet different aspects, the sensors 150*a* and 150*b* may measure temperature and the processor 180 may use a modeling process, which may be a theoretical or experimental model, to determine when the temperature is substantially equivalent to the temperature of the formation fluids, as they exist in the earth formation. Additionally, in other aspects different processing techniques may be used to determine when to split the flow, such techniques may range from using a simple temporal based constant—which may be determined theoretically, experimentally, from previous sampling or the like—determining an occurrence of a maximum, a minimum, an approach to an asymptote or the like of the output signal S from the sensor 150*a* and/or 150*b* or a variable associated with the output signal S.

In some aspects of the present invention, once the processor 180 has determined to switch the single flowline the sampling flowline 176 and the guard probe line 179, as depicted in FIG. 2B, it may control flow-lines, valves and/or the like to provide for the switch. The processor 180 may also provide for operation of a sampling valve 163 or the like to provide that after the switch of the single flowline to the sampling flowline 176 and the guard probe line 179 a sample of the fluid collected by the fluid sampling probe 24 may be collected in a collection vessel 166. In some aspects of the present invention, a collection vessel (not shown) may be coupled with the guard probe 26 to provide for collection of a fluid sample from the guard probe 26.

Figure 3:
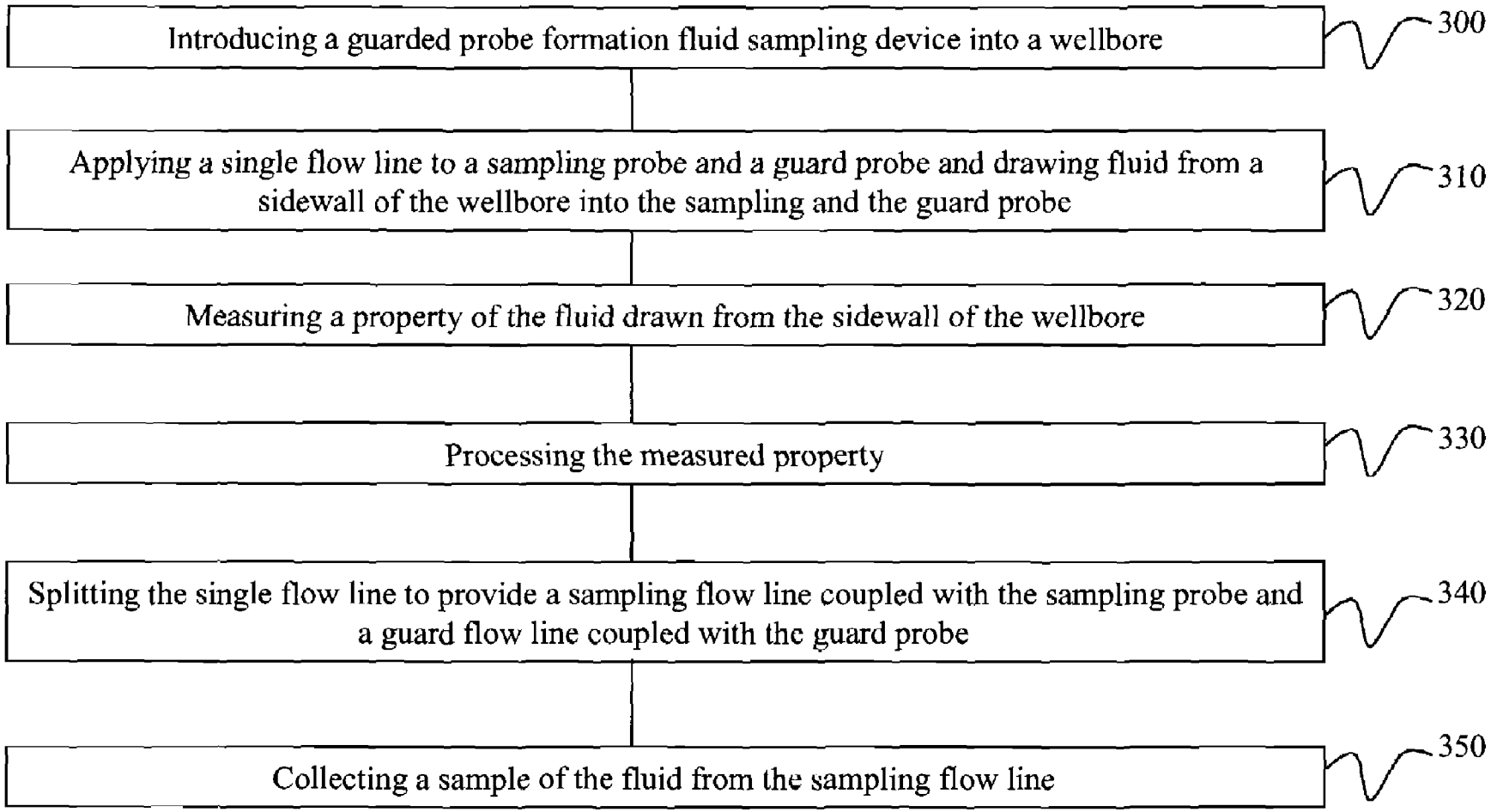
FIG. 3 is a flow-type schematic illustrating the functionality of a formation-fluid sampling system comprising a sampling and guarded probe and a flowline management system, in accordance with an embodiment of the present invention.

FIG. 3 is a flow-type schematic illustrating the functionality of a formation-fluid sampling system comprising a sampling and guarded probe and a flowline management system, in accordance with an embodiment of the present invention. In step 300, a guarded-probe-formation-fluid-sampling-device may be introduced into a wellbore. The guarded-probe-formation-fluid-sampling-device may be coupled with a wellbore tool and may comprise one or more formation fluid sampling probes and one or more guard probes, wherein the guard probes may be configured to draw off wellbore fluids to provide that the one or more formation fluid sampling probes may collect virgin formation fluids.

In step 310, the guarded-probe-formation-fluid-sampling-device may be configured to provide that the formation fluid sampling probes and the one or more guard probes are essentially coupled with a single flowline. This single flowline may provide for flowing of fluids from the sidewall of the wellbore and/or an earth formation adjacent to the sidewall through the probes and through the single flowline. The single flowline may be coupled with a pump or the like to provide for the drawing of the fluids from the sidewall of the wellbore and/or an earth formation adjacent to the sidewall into the guarded-probe-formation-fluid-sampling-device.

In step 320, one or more properties of the fluid flowing in guarded-probe-formation-fluid-sampling-device may be determined. Determination of the properties may be provided by a sensor or the like, wherein the sensor may be an OFA, a temperature sensor, a pressure sensor, a flowmeter and/or the like. The determined property may be a signal corresponding to wellbore contaminants detected by the sensor, temperature, pressure, viscosity, velocity, volume flow and/or the like. In step 330, the measured property or properties may be processed by a processor, software program or the like. The processing may comprise modeling successive measurements received from the sensor(s) according to a mathematical model, experimental model and/or past sampling model or using a database or look-up table. From the modeling, determinations may be made about the fluid being collected by the guarded-probe-formation-fluid-sampling-device. Merely by way of example, from a sensor signal corresponding to an amount of contaminants being sensed by the sensor, the processor may process an amount of the contaminants in the fluid in the fluid sampling probe. In some aspects, such a signal value may be interpolated with a flowmeter reading to determine an amount of such contaminants flowing in the fluid flowing in the guarded-probe-formation-fluid-sampling-device. The processor may determine when signals from the sensor reach a maximum or a minimum, tend towards an asymptotic value and/or the like.

In step 340, based upon a determination by the processor, the flow line to the one or more fluid sampling probes and the guarded probes may be split. In some embodiments of the present invention, only a flow line to the fluid sampling probes may be provided and upon the determination by the processor, a flow line to the guard probes may be provided to provide for a split flow line. In other embodiments, only a flow line to the guarded probes may be provided embodiments of the present invention, only a flow line to the fluid sampling probes may be provided and upon the determination by the processor, a flow line to the fluid sampling probes may be provided to provide for a split flow line. In step 350, after the splitting of the flow lines a sample of the fluid flowing in the fluid sampling flow line and/or the fluid sampling probe may be collected.

Figure 4B:
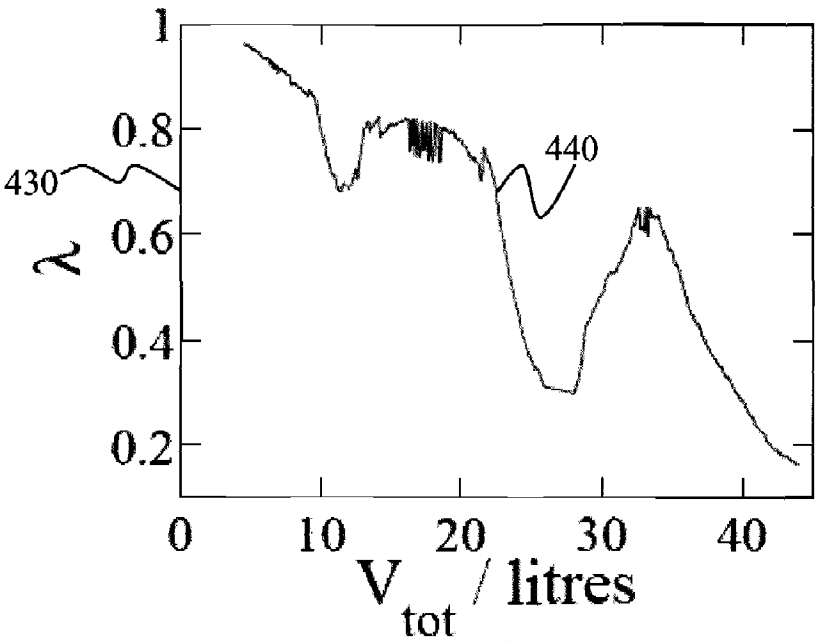
FIG. 4B illustrates modeling contamination of fluids withdrawn downhole from an earth formation using a guarded probe management system using sensor data, in accordance with an embodiment of the present invention.
Figure 4A:
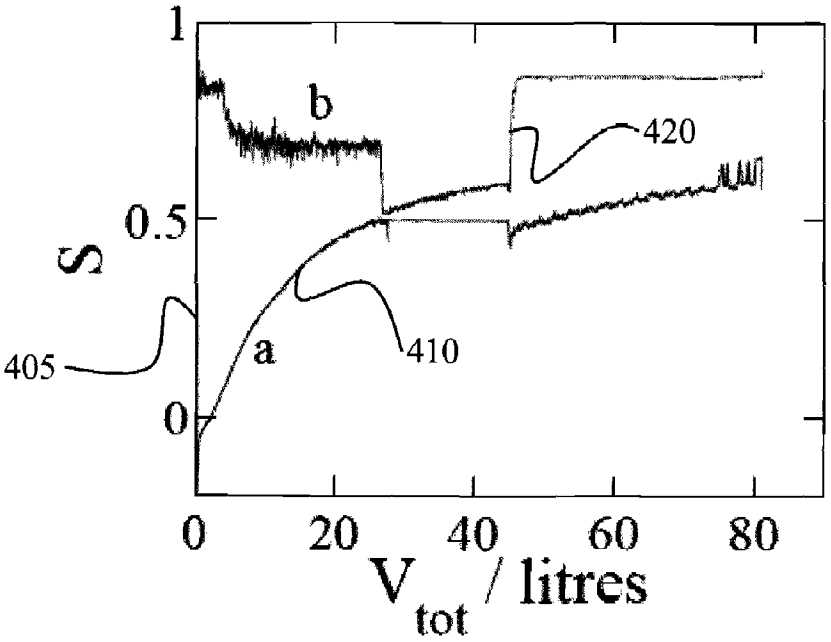
FIG. 4A illustrates signals obtained from a sensor in a guarded probe management system, in accordance with an embodiment of the present invention.

FIG. 4A illustrates signals obtained from a sensor in a guarded probe management system, in accordance with an embodiment of the present invention. In an embodiment of the present invention, an OFA may be used as a sensor and may generate a signal S 405 from (a) the guard flow line 410 and (b) the sampling flow line of a guarded probe 420. In the depicted illustration, the first 45 liters of fluid withdrawn by the guarded probe from the earth formation is withdrawn through only one flow line, as such, during this period the guarded probe is essentially acting as an unguarded probe. Furthermore, in certain aspects, the jump in OFA signal for the sampling probe line may be used to confirm that the guarded probe and OFA are working correctly.

FIG. 4B illustrates modeling contamination of fluids withdrawn downhole from an earth formation using a guarded probe management system using sensor data, in accordance with an embodiment of the present invention. From FIG. 4B, an estimate of a wellbore fluid contamination $\lambda$ 430 in the fluid withdrawn by the guarded probe may be modeled from the sensor data. This modeled prediction of the wellbore fluid contamination $\lambda$ 430 is shown as line 440. In an embodiment of the present invention, if estimate of the wellbore fluid contamination $\lambda$ 430 is lower than a certain threshold, constant or the like, the flow-lines of the guard probe may be split. In the illustrated example, the flow lines, sampling probe flowline and guard probe flowline, were split when $\lambda$ 430 was equal to 0.2 and the sampling probe immediately produced an uncontaminated sample of virgin formation fluids.

In one embodiment of the present invention, sensor signals, e.g. OFA signals, may be provided from whichever flow line is in use, Changes in sensor output may indicate changes in the concentration of wellbore fluid contaminants, such as drilling fluid filtrate contamination, in the fluid collected by the guarded probe. An assumption may be made of a linear relation between the signal S 405 and the wellbore fluid contamination λ 430 and, but this assumption may be unnecessary if the sensor has been calibrated. During the initial stages of fluid withdrawal, the flow-lines of the guarded probe may not be split and the guarded probe may effectively act as an unguarded probe, and all fluid may enter a single flowline. In certain aspects, the sensor data may be input into existing algorithms to predict a real-time best estimate δ of the value of the signal S 405 corresponding to pure formation fluid. If $S_f$ is a value of the signal S 405 corresponding to pure wellbore fluid contamination λ 430, and if the sensor signal is linear in the amount of contamination, a real-time value of the signal S 405 may correspond to a contamination of the sampled fluid given by:

$$\lambda = \frac{S - S_f}{\delta - Sf} \tag{1}$$

However, in other aspects, any alternative method for estimating the contamination c from the sensor data may be used instead of equation (1). Modeling of contamination in the guarded probe may be provided based upon an assumption that the contamination in the sampled fluids may be a decreasing function of the fluid volume pumped into the guarded sampling probe. In certain embodiments, the modeling of the contamination may be based upon the relationship that:

$$c \propto V^{\alpha} \text{ where } \alpha = -\frac{5}{12}$$

As such, $$c = \left(\frac{V}{V_i}\right)^{\alpha}$$

for some volume $V_i$ which can be used to define a length-scale, $$r_i = \left(\frac{3V_i}{4\pi\phi}\right)^{1/3}$$

where φ is the porosity of the rock. In such modeling, $r_i$ may be treated as being related to the depth of filtrate invasion around the wellbore and the pumped volume V may be used to define a depth $R=(3V/4\pi\phi)^{1/3}$ from which fluid has been withdrawn from the wellbore sidewall/earth formation. As such, if c is known, modeling may be used to determine:

$$\frac{R}{r_i} = c^{1/(3\alpha)} \tag{2}$$

As the fluid is withdrawn from the earth formation for a longer period, so R increases and c decreases (since $\alpha<0$). If the sampling probe flow rate is very small, it may collect contamination-free formation fluid when $R>r_i$. In more complex modeling analysis, effects such as dispersion and the complex geometry for flow around the wellbore may be considered and included in processing. In modeling that does not include these effects, a margin for error may be provided for and the flow-lines may be split when $c<c_{split}<1$. In certain aspects, a small value of $c_{split}$ may be used provided that fluids are withdrawn for longer will pump for longer and $R/r_i$ may be greater. In some embodiments of the present invention, the best estimate of the λ 430 may be used as a real-time value of c in equation (2).

In FIG. 4A an estimate of the wellbore fluid contamination λ 430 for the contamination in the total flow is shown based upon a least squares fit of the signal S 405 to a form:

$$S=\beta V^{\alpha}+\delta \tag{3}$$

using at each step the last half of the data points collected so far. In alternative aspects, the power law index α could be fixed, and set e.g. to $\alpha=-5/12$.

Figure 4C:
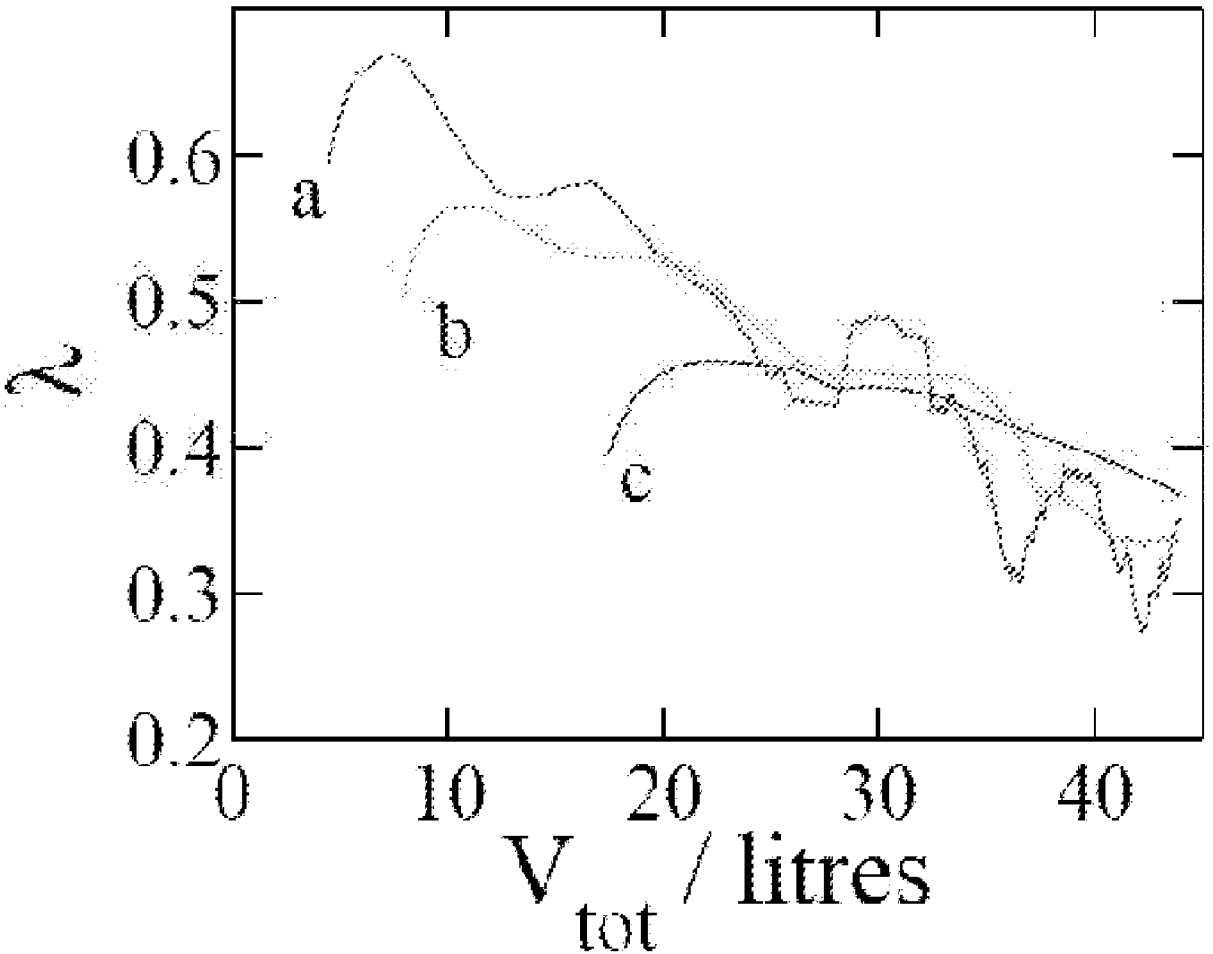
FIG. 4C illustrates modeling contamination of fluids withdrawn downhole from an earth formation using a guarded probe management system using sensor data and using a different estimate of fluid contamination when flow lines of the guarded probe are split then is used in FIG. 4B, in accordance with an embodiment of the present invention.

FIG. 4C illustrates estimates of fluid contamination λ obtained when fitting the data from FIG. 4A to equation (3), using at each time the last N data points, with (a) N=100, (b) N=200 and (c) N=400. The estimates of λ in FIG. 4C are broadly similar to those in FIG. 4B, but may be considered as rather more conservative, with λ=0.35 when the flow-lines are split.

Letting $Q_{g2}$ and $Q_{s2}$ be the volumetric flow rates into the guard and sampling flow lines immediately after separation, with corresponding OFA (or other sensor) readings $S_{g2}$, $S_{S2}$ and letting $S_1$ be the sensor reading immediately prior to the split. Then if S is proportional to contamination, it may be provided that:

$$\frac{Q_{s2}S_{s2} + Q_{g2}S_{g2}}{Q_{s2} + Q_{g2}} = S_1 \tag{4}$$

In certain embodiments of the present invention, this relation may be used to confirm in real-time that the sensors in the guard and sampling flow lines are behaving as expected.

In certain aspects, the precise value of $c_{split}$ for which the flow lines should be split may vary somewhat with the choice of α. This choice of a may be decided by field trials. A value $c_{split}$ may also be expected to vary with the ratio of the volumetric flow rates into the sampling and guard flow lines. The larger this ratio becomes, the longer the wait period may be until the fluids in the sampling probe become filtrate-free, and the smaller $c_{split}$ may be. The contamination estimate λ may be made using the current analysis based on a fixed power law-index, but any other method for estimating c may be used, if used consistently.

Certain embodiments of the present invention may also provide for the use of data from the sensors in the flow lines, combined with suitable models, for purposes other than determinations as to when to separate the flow lines, to collect samples or the like. For example, data from the sensors in the flow lines may be combined with suitable models to provide information about the reservoir fluid, rock formations/characteristics around the wellbore—either close to the wellbore or further out into the reservoir—or the like.

Merely by way of example, from the sensor readings and suitable models, the concentration profile of filtrate contamination as a function of distance away from the wellbore may be analyzed. This profile may be of interest because of its effect upon the interpretation of electrical wireline logs since such information may provide for man understanding regarding the permeability and relative permeability of the surrounding rock formations and, among other things, how these permeabilities may be influencing/controlling flow of fluids in the pores of the rock. In theory, in certain embodiments it may be possible to obtain information about this radial profile of contamination by inverting the mathematical formulae describing the simple model of Hammond (see P. S Hammond, *One-and two-phase flow duringfluid sampling by a wireline tool*, Transport in Porous Media 6 pges 29-330 (1991)) and applying this inverse model to contamination data collected by means of an unguarded probe.

In other aspects, models and analysis of flow into a guarded probe may be used with the sensor data. In such modeling, in certain aspects of the present invention, the models may be analysed/modified on a basis that the central sampling region of the guarded probe may collect only a small proportion of the total flow of fluids towards the probe device, and the fluid in the sample flow line may be drawn in through the probe along a line perpendicular to the wellbore in isotropic rock (persons of skill in the art may appreciate that the modification to model an anisotropic rock formation may also be understood by employing necessary variants). In certain aspects, to analyze contamination/rock around the wellbore, processing of data may be based on an analysis in which the contamination measured in the sample flow line may be taken to correspond to the contamination along the radius away from the wellbore, and a simple model based on spherical flow towards the probe may therefore be used to relate the time at which contamination is measured to the radial position from which this fluid originated. This model may be further enhanced by allowing for the dispersion that occurs as the fluid is drawn through the rock towards the sampling probe.

In another embodiment of the present invention, the temperature distribution away from the wellbore, and in particular the temperature in the reservoir far from the wellbore may be ascertained from the sensor data and an appropriate model. Persons of skill in the art may appreciate that models for the temperature distribution around a wellbore may be used in conjunction with temperature measurements in an unguarded probe to estimate reservoir temperature. However, fluid entering an unguarded probe is contaminated by filtrate, which is typically at a temperature different to (usually lower than) that of the reservoir. The measured temperature therefore differs from that of the reservoir, i.e., it may be too low, and as such measured data may have to be extrapolated by means of a model in order to determine the reservoir temperature.

In aspects of the present invention, analysis may be made on a model wherein when a guarded probe is used for sampling, the sample flow line of the guarded probe may eventually collects pure pore fluid. The temperature of this fluid will have been modified by its passage through (typically cooler) rock near the wellbore, but the fluid travels perpendicular to the wellbore and so the distance over which cooling occurs may be minimal. In consequence, the temperature of fluid in the sample flow line may approaches that of the reservoir more quickly than does the temperature of fluid collected by an unguarded probe. As such, the amount of extrapolation required is reduced compared to an unguarded probe sampling device. Thereby, the guarded probe may provide for improving the measurement accuracy, and the time taken to collect the data can be reduced, thereby reducing costs and reducing the probability of the tool or cable becoming stuck downhole due to differential pressure sticking. The model required for extrapolation of data is also simplified, since fluid flow towards the sampling probe occurs over a narrow cone if the sampling probe takes only a small proportion of the total flow, and so flow is close to 1-dimensional.

In the foregoing description, for the purposes of illustration, various methods and/or procedures were described in a particular order. It should be appreciated that in alternate embodiments, the methods and/or procedures may be performed in an order different than that described. It should also be appreciated that the methods described above may be performed by hardware components and/or may be embodied in sequences of machine-executable instructions, which may be used to cause a machine, such as a general-purpose or special-purpose processor or logic circuits programmed with the instructions, to perform the methods.

Hence, while detailed descriptions of one or more embodiments of the invention have been given above, various alternatives, modifications, and equivalents will be apparent to those skilled in the art without varying the invention. Moreover, except where clearly inappropriate or otherwise expressly noted, it should be assumed that the features, devices and/or components of different embodiments may be substituted and/or combined. Thus, the above description should not be taken as limiting the scope of the invention, which is defined by the appended claims.

What is claimed is:

1. A method for operating a guarded sampling probe in a wellbore to sample formation fluids from a formation surrounding the wellbore, comprising:

lowering a wellbore tool coupled with the guarded sampling probe into the wellbore, wherein the guarded sampling probe comprises a sampling probe and a guard probe, and wherein the sampling probe is coupled with a sampling flowline and a sampling pump and the guard probe is coupled with a guard flowline and a guard pump;

urging both the guard probe and the sampling probe into contact with a sidewall of the wellbore;

operating the guarded sampling probe in a first mode, which comprises controlling the sampling pump and the guard pump so that the sampling flowline and the guard flowline have equivalent characteristics and operate as essentially a single flowline, such that pressures in the guard probe and the sampling probe are equal;

using the sampling probe and the guard probe operating as essentially a single flowline to remove fluid from the formation, wherein the fluid comprises at least one fluid selected from the group consisting of the formation fluid, drilling fluid and a filter cake;

using a sensor to generate signals in response to variations in a concentration of contamination present in at least one of the fluid in the sampling flowline and the fluid in the guard flowline, wherein the contamination comprises substances other than the formation fluid;

using a processor to process a contamination concentration from the signals; and operating the guarded sampling probe in a second mode when the processed contamination concentration in at least one of the fluid in the sampling flowline or the fluid in the guard flowline falls below a threshold value, wherein, in said second mode, fluid is withdrawn through the sampling probe and sampling flowline without coming into contact with fluid withdrawn through the guard probe, and collecting a sample of the formation fluid from the sampling flowline.

2. The method according to claim 1, wherein the threshold value corresponds to the contamination concentration having a value greater than zero.

3. The method according to claim 1, wherein the step of using a processor to process a value for the contamination concentration from the signals comprises using the processor to process the signals in real-time to generate an estimate of a peak signal value and to process a contamination concentration from the signals and the estimate of the peak signal value, wherein the estimated peak signal value is a value of the signals corresponding to uncontaminated formation fluid.

4. The method according to claim 3, wherein the threshold value is determined from a depth of filtrate invasion around the wellbore.

5. The method according to claim 1, wherein the threshold value is processed in real-time from the processed contamination concentration and a volume of fluid removed by the guarded sampling probe.

6. The method according to claim 1, further comprising:

identifying an increased rate of decline in the processed contamination concentration as confirmation that the guarded sampling probe has changed from the first mode to the second mode.

7. The method according to claim 1, wherein the sample of the formation fluid is collected after the signals reach a maximum value.

8. The method according to claim 1, wherein the sampling probe comprises an inner probe and the guard probe comprises an outer probe, and wherein the outer probe surrounds the inner probe.

9. The method according to claim 1, wherein the sensor comprises an optical fluid analyzer.

10. The method according to claim 1, wherein the threshold value is determined by means of a technique fluid selected from the group consisting of a mathematical model, experimentation and prior downhole sampling of fluids.

11. A system for managing sampling of formation fluids from an earth formation surrounding a wellbore using a guarded sampling probe, comprising:

a wellbore tool configured to be manipulated inside the wellbore;

a guarded sampling probe coupled with the wellbore tool and configured for withdrawing fluids from the formation, wherein the guarded sampling probe comprises a sampling probe and a guard probe configured for both probes to contact a sidewall of a wellbore, and wherein the guarded probe is configured to draw wellbore fluids away from the sampling probe;

a guard flowline coupled with the guard probe;

a guard pump coupled with the guard flowline;

a sampling flowline coupled with the sampling probe;

a sampling pump coupled with the sampling flowline;

a sensor configured to sense changes in contamination of fluid in one of the guard flowline or the sampling flowline and to generate output signals corresponding to the sensed changes;

a processor coupled with the sensor and configured to process a contamination concentration from the signals;

a controller configured to change operation of the guarded sampling probe from unguarded operation to guarded operation when the contamination concentration falls below a threshold level, wherein unguarded operation comprises operating the sampling pump and the guard pump so that the sampling flowline and the guard flowline have equivalent characteristics providing equal pressures in the sampling probe and guard probe, and operate as essentially a single flowline, and wherein guarded operation comprises operating the sampling pump and the guard pump so that the sampling flowline and the guard flowline have different characteristics and operate as separate flowlines; and a collection container coupled with the sampling flowline configured to collect a portion of the formation fluids withdrawn by the sampling probe without contact with fluid withdrawn through the guard probe.

12. The system of claim 11, wherein the sensor is an optical fluid analyzer.

13. The system of claim 11, further comprising:

a flowmeter configured to measure a volume of fluid collected by the guarded sampling probe.

14. A method for operating a guarded sampling probe in a wellbore to sample formation fluids from a formation surrounding the wellbore, comprising:

lowering a wellbore tool coupled with the guarded sampling probe into the wellbore, wherein the guarded sampling probe comprises a sampling probe and a guard probe, and wherein the sampling probe is coupled with a sampling flowline and the guard probe is coupled with a guard flowline;

urging both the guard probe and the sampling probe into contact with a sidewall of the wellbore;

operating the guarded sampling probe in an unguarded mode to remove fluid from the formation, wherein the fluid comprises at least one fluid selected from the group consisting of the formation fluid, drilling fluid and a filter cake, wherein the step of operating the guarded sampling probe in the unguarded mode comprises withdrawing fluid from the formation through both the sample probe and the guard probe while both probes are open to a single flow line, such that pressures in the sampling probe and guard probe are equal and an open flowpath leads fluids withdrawn through the probes into contact with each other within the single flow line;

using a sensor to generate signals in response to variations in a concentration of contamination present in fluid withdrawn from the formation, wherein the contamination comprises substances other than the formation fluid;

using a processor to process a contamination concentration from the signals;

operating the guarded sampling probe in a guarded mode when the processed contamination concentration in at least one of the fluid in the sampling flowline or the fluid in the guard flowline falls below a threshold value, wherein the step of operating the guarded sampling probe in a guarded mode comprises separating the sampling flowline and the guard flowline and closing said flowpath so that it no longer leads fluids into contact; and, collecting a sample of the formation fluid withdrawn through the sampling probe and sampling flowline without coming into contact with fluid withdrawn through the guard probe.

15. The method according to claim 14, wherein the threshold value corresponds to the contamination concentration having a value greater than zero.

16. The method according to claim 14, wherein the step of using a processor to process a value for the contamination concentration from the signals comprises using the processor to process the signals in real-time to generate an estimate of a peak signal value and to process a contamination concentration from the signals and the estimate of the peak signal value, wherein the estimated peak signal value is a value of the signals corresponding to uncontaminated formation fluid.

17. The method according to claim 16, wherein the threshold value is determined from a depth of filtrate invasion around the wellbore.

18. The method according to claim 14, wherein the threshold value is processed in real-time from the processed contamination concentration and a volume of fluid removed by the guarded sampling probe.

19. The method according to claim 14, further comprising:

identifying an increased rate of decline in the processed contamination concentration as confirmation that the guarded sampling probe has changed from the unguarded mode to the guarded mode.

20. The method according to claim 14, wherein the sample of the formation fluid is collected after the signals reach a maximum value.

21. The method according to claim 14, wherein the sampling probe comprises an inner probe and the guard probe comprises an outer probe, and wherein the outer probe surrounds the inner probe.

22. The method according to claim 14, wherein the sensor comprises an optical fluid analyzer.

23. The method according to claim 14, wherein the threshold value is determined by means of a technique fluid selected from the group consisting of a mathematical model, experimentation and prior downhole sampling of fluids.

24. A system for managing sampling of formation fluids from an earth formation surrounding a wellbore using a guarded sampling probe, comprising:

a wellbore tool configured to be manipulated inside the wellbore;

a guarded sampling probe coupled with the wellbore tool and configured for withdrawing fluids from the formation, wherein the guarded sampling probe comprises a sampling probe and a guard probe configured for both probes to contact a sidewall of a wellbore, and wherein the guarded probe is configured to draw wellbore fluids away from the sampling probe;

a guard flowline coupled with the guard probe;

a sampling flowline coupled with the sampling probe;

at least one pump coupled with the guard and sampling flowlines;

a sensor configured to sense changes in contamination of fluid in one of the guard flowline or the sampling flowline and to generate output signals corresponding to the sensed changes;

a processor coupled with the sensor and configured to process a contamination concentration from the signals; and a controller configured to change operation of the guarded sampling probe from unguarded operation to guarded operation when the contamination concentration falls below a threshold level, wherein unguarded operation comprises configuring and operating the system so that both probes are open to a single flowline such that pressures in the sampling probe and guard probe are equal and an open flowpath leads fluids withdrawn through the probes into contact with each other within the single flow line, and wherein guarded operation comprises closing said flowpath and separating the sampling flowline and the guard flowline; and a collection container coupled with the sampling flowline configured to collect a portion of the formation fluids withdrawn by the sampling probe without contact with fluid withdrawn through the guard probe.

25. The system of claim 24, wherein the threshold value corresponds to the contamination concentration having a value greater than zero.

26. The system of claim 24, wherein the sensor is an optical fluid analyzer.

27. The system of claim 24, further comprising:

a flowmeter configured to measure a volume of fluid collected by the guarded sampling probe.

* * * * *